US010045109B2

(12) United States Patent
Kemmochi

(10) Patent No.: US 10,045,109 B2
(45) Date of Patent: Aug. 7, 2018

(54) ACOUSTIC DEVICE AND METHOD OF DETECTING ABNORMAL SOUND

(75) Inventor: Chisato Kemmochi, Kanagawa (JP)

(73) Assignee: Sony Corporation, Tokyo (JP)

( * ) Notice: Subject to any disclaimer, the term of this patent is extended or adjusted under 35 U.S.C. 154(b) by 574 days.

(21) Appl. No.: 13/453,038

(22) Filed: Apr. 23, 2012

(65) Prior Publication Data

US 2012/0288105 A1 Nov. 15, 2012

(30) Foreign Application Priority Data

May 9, 2011 (JP) ..... 2011-104034

(51) Int. Cl.
*H04R 1/10* (2006.01)
*H04R 5/04* (2006.01)
*H04R 5/033* (2006.01)

(52) U.S. Cl.
CPC ..... *H04R 1/1041* (2013.01); *H04R 5/04* (2013.01); *H04R 1/1016* (2013.01); *H04R 5/033* (2013.01); *H04R 2430/01* (2013.01)

(58) Field of Classification Search
CPC ..... H04M 3/2236
USPC ..... 381/71.11, 109, 58, 73.1, 99, 107, 86, 381/302
See application file for complete search history.

(56) References Cited

U.S. PATENT DOCUMENTS 5,369,711 A * 11/1994 Williamson, III ..... 381/104
6,118,878 A * 9/2000 Jones ..... G10K 11/178 381/72
8,467,524 B1 * 6/2013 Lee ..... H04M 1/2471 379/388.02
2008/0044040 A1 * 2/2008 Werner, Jr. ..... H04R 25/407 381/111
2009/0085764 A1 * 4/2009 Jee ..... G08C 23/04 340/4.31
2009/0091441 A1 * 4/2009 Schweitzer, III ... G01M 13/028 340/531
2009/0154739 A1 * 6/2009 Zellner ..... H04R 1/1041 381/311
2009/0245529 A1 * 10/2009 Asada ..... G10K 11/17881 381/71.6
2010/0020998 A1 * 1/2010 Brown ..... H04R 1/1041 381/380
2010/0248645 A1 * 9/2010 Iio ..... H04B 1/40 455/73

FOREIGN PATENT DOCUMENTS

JP 2009-141880 A 6/2009

* cited by examiner

*Primary Examiner* — Duc Nguyen
*Assistant Examiner* — Yogeshkumar Patel
(74) *Attorney, Agent, or Firm* — Chip Law Group

(57) ABSTRACT

An earplug unit includes a signal processing unit. The earplug unit is inserted into an external auditory canal and then used. In the earplug unit, a speaker is arranged at an eardrum side, and a microphone is arranged at a side opposite to the eardrum side. The microphone collects a sound in which a user's head shape or auricle characteristic is reflected. An output signal of the microphone is amplification-processed by a volume adjusting unit and then supplied to the speaker. An amplified sound is output from the speaker. A frequency characteristic is smoothed in a band larger than at least an audible frequency band in a system from the microphone to the speaker.

8 Claims, 9 Drawing Sheets

FREQUENCY CHARACTERISTIC EXAMPLE OF MICROPHONE-SPEAKER SYSTEM

FREQUENCY CHARACTERISTIC CORRECTION METHOD

ACOUSTIC DEVICE AND METHOD OF DETECTING ABNORMAL SOUND

BACKGROUND

The present technology relates to an acoustic device and a method of detecting an abnormal sound. Particularly, the present technology relates to an acoustic device that allows a user to appreciate music at a satisfactory volume in an environment in which sound leakage to an area around the user's room needs to be considered without damaging features of a music appreciation environment constructed by the user.

In hobbies associated with sound such as music appreciation, movie appreciation, or video games, users concerned with acoustic quality desire to construct their favorite music appreciation environment and enjoy music at a large volume. It is good to use an audio room on which sound insulation treatment has been performed or the like, however, when the audio room or the like is not available, it is difficult to increase a volume up to a satisfactory level in consideration of the neighborhood. Particularly, it is necessary to further reduce a volume at night or the like.

For example, it is possible to enjoy music at a satisfactory volume using a surround headphones disclosed in Japanese Patent Application Laid-Open No. 2009-141880. However, in this case, there are problems in that it is different from a preferred replay environment, and when two or more people are appreciating music using headphones, they are unable to talk to each other.

SUMMARY

The present technology is made in light of the foregoing, and it is desirable to cause the user to appreciate music at a satisfactory volume in an environment in which sound leakage to an area around the user's room needs to be considered without damaging features of a music appreciation environment constructed by the user.

The aspect of the present technology is an acoustic device, comprising:

an earplug unit that is inserted into an external auditory canal, and includes a speaker arranged at an eardrum side and a microphone arranged at a side opposite to the eardrum side, and a signal processing unit that processes an output signal of the microphone and supplies the processed signal to the speaker. The signal processing unit includes a volume adjusting unit that performs an amplification process on the output signal of the microphone, and a frequency characteristic is smoothed in a band larger than at least an audible frequency band in a system from the microphone to the speaker.

The acoustic device of the present technology is configured to include the earplug unit and the signal processing unit. The earplug unit is inserted into an external auditory canal and then used. In the earplug unit, a speaker is arranged at an eardrum side, and a microphone is arranged at a side opposite to the eardrum side. The microphone collects a sound. An output signal of the microphone is amplification-processed by a volume adjusting unit and then supplied to the speaker. A sound amplified to a desired level is output from the speaker. In the present technology, a frequency characteristic is smoothed in a band larger than at least an audible frequency band in a system from the microphone to the speaker.

In the present technology, since the microphone is arranged in the earplug unit inserted into the external auditory canal, the microphone can collect a sound in which a user's head shape or auricle characteristic is reflected. Further, in the present technology, since a frequency characteristic is smoothed in a band larger than at least an audible frequency band in a system from the microphone to the speaker, the sound collected by the microphone can be output from the speaker without changing the sound quality. Further, since the earplug unit is inserted into the external auditory canal and then used, sound is prevented from directly arriving at the eardrum without passing through the system from the microphone to the speaker. When the sound is directly heard, the sound is slightly different from the sound output after passing through the system from the microphone to the speaker, and so an uncomfortable feeling occurs. However, in the present technology, this situation is avoided.

Thus, in the present technology, the user can appreciate music at a satisfactory volume in an environment in which sound leakage to an area around the user's room needs to be considered without damaging features of a music appreciation environment (the sound quality, a speaker arrangement, and the like) constructed by the user.

According to the present technology, for example, the signal processing unit may further include a frequency characteristic correcting unit that performs frequency characteristic correction of a characteristic opposite to a frequency characteristic in the system from the microphone to the speaker on the output signal of the microphone. In this case, the frequency characteristic correcting unit performs the frequency characteristic correction, and thus a frequency characteristic is smoothed in a band larger than at least an audible frequency band in a system from the microphone to the speaker. Thus, the system from the microphone to the speaker need not be configured with very expensive hardware having an excellent frequency characteristic and so can be configured at a low cost.

Further, according to the present technology, for example, the signal processing unit may further include a mute processing unit that performs a mute process on the output signal of the microphone. By arranging the mute processing unit in this way, loud sound is prevented from being output from the speaker, and so the acoustic sense can be protected.

Further, the earplug unit may include, for example, an attaching/detaching auxiliary tool having a built-in touch sensor, and the mute processing unit performs a mute operation based on an output of the touch sensor. In this case, when the user inserts or removes the earplug unit using the attaching/detaching auxiliary tool, the sound from the speaker can be muted. Thus, when the earplug unit is inserted or removed, the loud sound generated as the earplug unit rubs against the external auditory canal can be prevented from being output from the speaker.

The signal processing unit may further include, for example, an abnormal sound detecting unit that detects an abnormal sound based on the output signal of the microphone, and the mute processing unit performs a mute operation based on a detection output of the abnormal sound detecting unit. In this case, when an abnormal sound having a significantly changed gain is collected by the microphone, the sound from the speaker can be muted. Thus, the abnormal sound can be prevented from being output from the speaker.

The abnormal sound detecting unit includes, for example, an abnormal sound detection work buffer that sequentially stores the output signal of the microphone, a gain abnormality detecting unit that detects gain abnormality by scanning a signal stored in the abnormal sound detection work buffer in a time direction and inspecting whether or not a signal gain is abnormal, a time-frequency transforming unit that performs a time-frequency transform on a signal stored in the abnormal sound detection work buffer, a frequency power spectrum calculating unit that calculates power of each spectrum based on an output of the time-frequency transforming unit and calculates a frequency power spectrum, an abnormal sound frequency characteristic detecting unit that compares the frequency power spectrum calculated by the frequency power spectrum calculating unit with a characteristic of a frequency power spectrum of a predefined abnormal sound, and detects an abnormal sound, and an abnormal sound detection determining unit that obtains the detection output of the abnormal sound detecting unit based on detection results of the gain abnormality detecting unit and the abnormal sound frequency characteristic detecting unit.

According to the present technology, for example, the earplug unit includes an outer member that comes into contact with the external auditory canal and an inner member whose outer circumference is covered with the outer member, and the speaker and the microphone are arranged in the inner member. As described above, the earplug unit has the dual structure. Since the earplug unit is inserted into or removed from the external auditory canal many times, the outer side of the earplug unit gets dirty or damaged. However, since the earplug unit has the dual structure, the outer member can be easily restored to its original condition by replacement.

According to an embodiment of the present technology, the user can appreciate music at a satisfactory volume in an environment in which sound leakage to an area around the user's room needs to be considered without damaging a feature of a music appreciation environment constructed by the user.

DETAILED DESCRIPTION OF THE EMBODIMENTS

Figure 1:
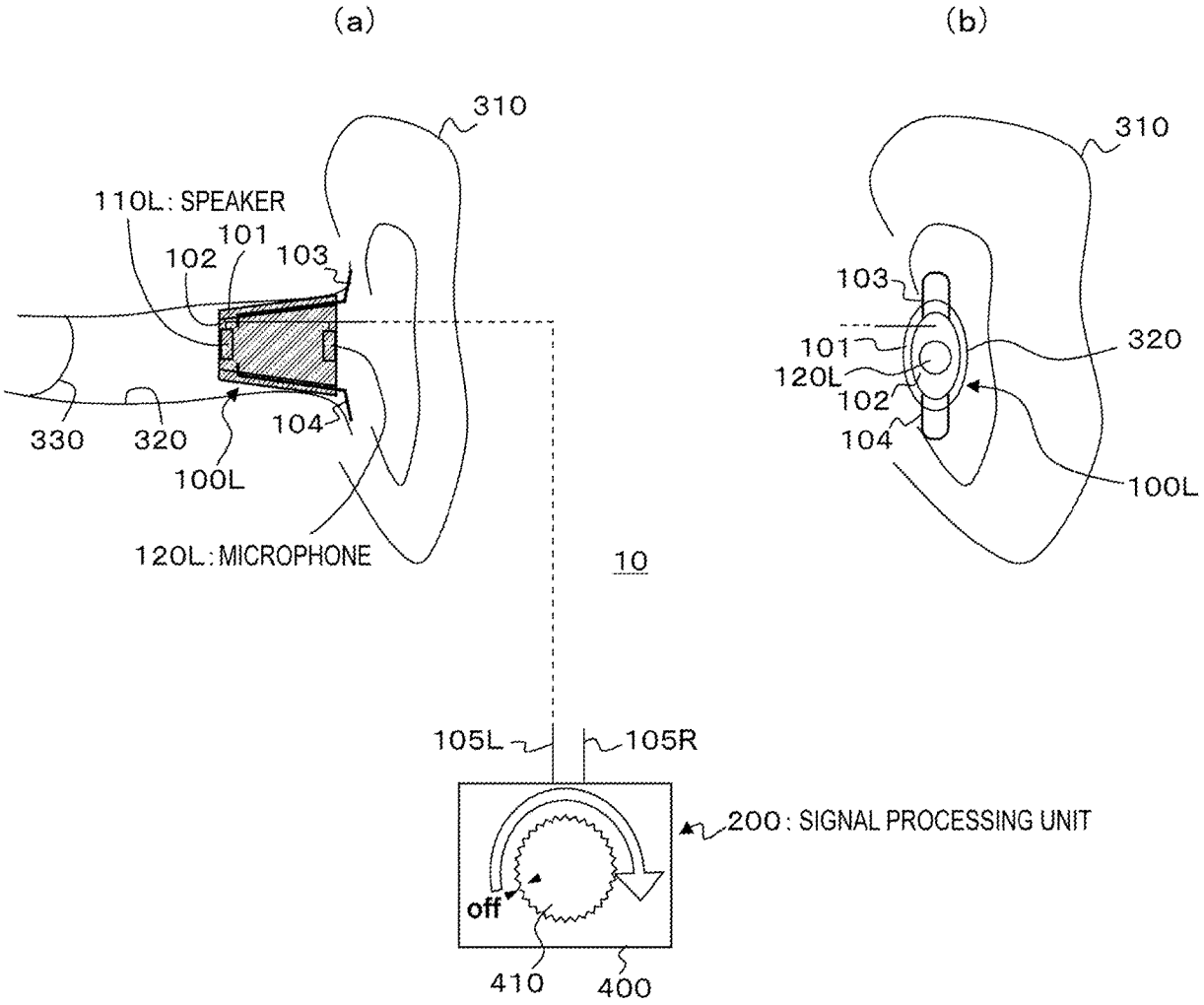
FIGS. 1A and 1B are diagrams illustrating a configuration example of an earplug unit of an acoustic device according to a first embodiment of the present technology.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Hereinafter, embodiments for embodying the present technology (hereinafter referred to as "embodiments") will be described with reference to the appended drawings. A description will be made in the following order.

1. First Embodiment
2. Second Embodiment
3. Third Embodiment
4. Modified Embodiment

1. First Embodiment

Configuration of Acoustic Device

FIGS. 1A and 1B illustrate a configuration example of an acoustic device 10 according to a first embodiment of the present technology. The acoustic device 100 includes earplug units 100L and 100R and a signal processing unit 200. The earplug unit 100L is for the left ear, the earplug unit 100R is for the right ear, and the earplug units 100L and 100R have the same configuration. FIGS. 1A and 1B illustrate only the earplug unit 100L for the left ear for simplicity of the drawings.

A left ear portion of FIG. 1A schematically illustrates an auricle 310 and an external auditory canal 320 when viewed in a front direction. A left ear portion of FIG. 1B schematically illustrates the auricle 310 and the external auditory canal 320 when viewed in a side direction. The earplug unit 100L is inserted into the external auditory canal 320 and then used as illustrated in FIG. 1A.

A speaker 110L is arranged at an eardrum 330 side of the earplug unit 100L. Further, a microphone 120L is arranged at a side opposite to the eardrum 330 side of the earplug unit 100L. The earplug unit 100L includes an outer member 101 that comes into contact with the external auditory canal 320 and an inner member 102 whose outer circumference is covered with the outer member 101. The outer member 101 and the inner member 102 are configured with a soft material such as polyurethane or silicon. The speaker 110L and the microphone 120L are arranged in the inner member 102.

Since the earplug unit 100L is repetitively inserted into or removed from the external auditory canal 320, the outer side of the earplug unit 100L that comes into contact with the external auditory canal 320 gets dirty or damaged. As described above, the earplug unit 100L has a dual structure of the outer member 101 and the inner member 102. Thus, the outer member 101 can be easily restored to its original condition by replacement.

The earplug unit 100L includes attaching/detaching auxiliary tools 103 and 104. In each of the attaching/detaching auxiliary tools 103 and 104, a leading end of one end is embedded in and fixed to the inner member 102, and the other end passes between the outer member 101 and the inner member 102 and is led out to the outside. In this embodiment, each of the attaching/detaching auxiliary tools 103 and 104 includes a built-in touch sensor (not shown).

As will be described later, a mute circuit arranged in the signal processing unit 200 is configured to perform a mute operation based on an output of the touch sensor. For example, each of the attaching/detaching auxiliary tools 103 and 104 is configured with a conductive member such as metal. The attaching/detaching auxiliary tools 103 and 104 are configured to cause an electric current to flow when both of them are brought into contact at the same time. As the electric current flows, the mute circuit operates.

Each of the attaching/detaching auxiliary tools 103 and 104 is made of a plastic deformable material, and a portion led to the outside can be bent or stretched. In a state in which the earplug unit 100L is inserted into the external auditory canal 320, the portion led to the outside can be bent to the auricle 310 side or the head side not to protrude.

A signal line 105L, which is connected to the speaker 110L, the microphone 120L, the touch sensor, and the like, is led from the inner member 102 of the earplug unit 100L. The signal line 105L extends to a housing 400 in which the signal processing unit 200 is arranged. Although a detailed description will be omitted, a signal line 105R led out from the earplug unit 100R for the right eye also extends to the housing 400. An adjusting knob 410 that allows the user to adjust a volume is arranged in the housing 400.

Figure 2:
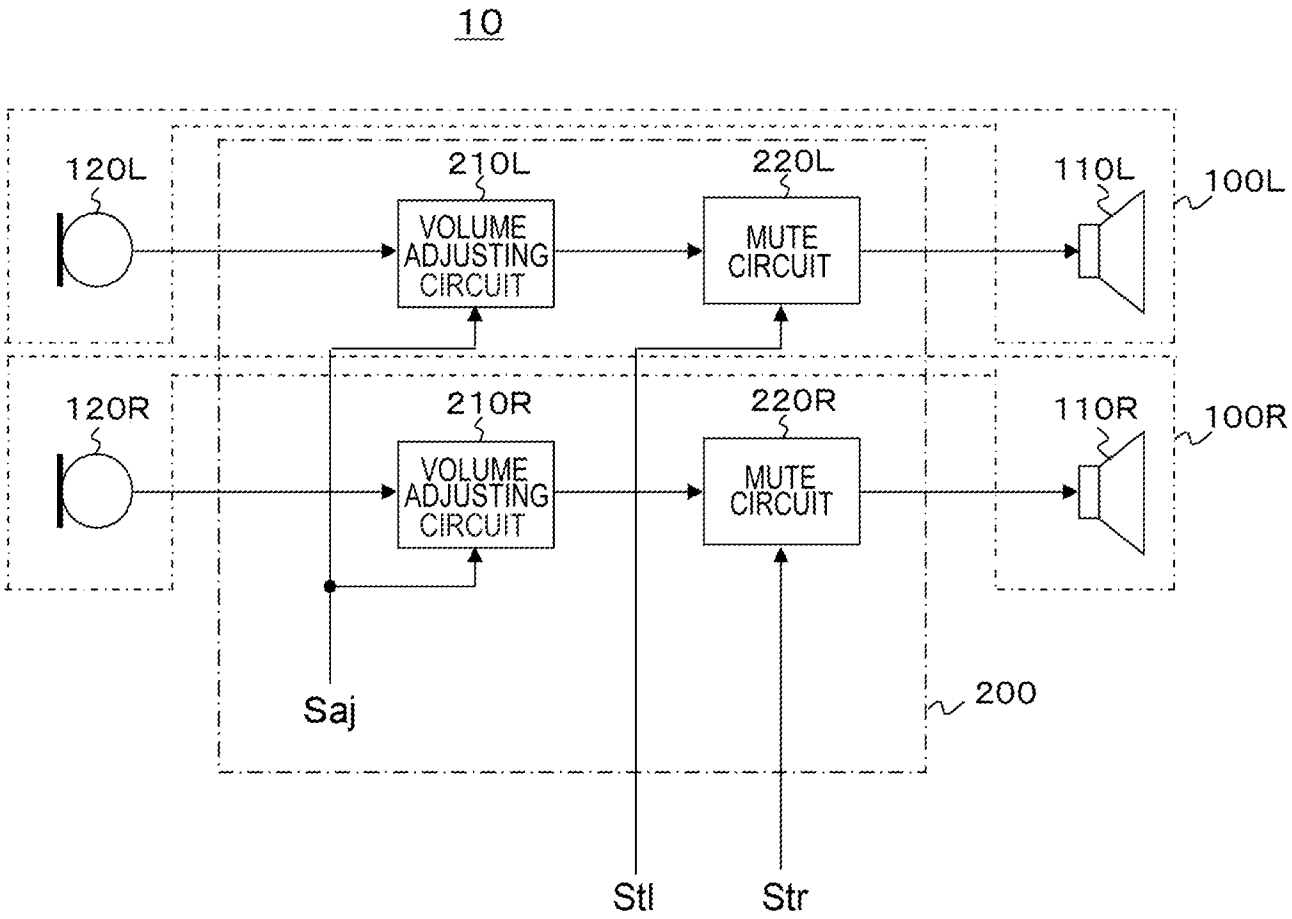
FIG. 2 is a block diagram illustrating a circuit configuration example of the acoustic device according to the first embodiment of the present technology.

FIG. 2 illustrates a circuit configuration example of the acoustic device 10. The signal processing unit 200 arranged in the housing 400 includes a volume adjusting circuit 210L and a mute circuit 220L as a left signal system and includes a volume adjusting circuit 210R and a mute circuit 220R as a right signal system. For example, each of the volume adjusting circuits 210L and 210R is configured with a variable gain amplifier (VGA). Gains of the volume adjusting circuits 210L and 210R are commonly adjusted based on an adjusting signal Saj generated according to a rotational position of the adjusting knob 410.

The volume adjusting circuit 210L performs an amplification process on the output signal of the microphone 120L. The mute circuit 220L performs a mute process on a signal to be supplied from the volume adjusting circuit 210L to the speaker 110L. Similarly, the volume adjusting circuit 210R performs the amplification process on the output signal of the microphone 120R. The mute circuit 220R performs a mute process on a signal to be supplied from the volume adjusting circuit 210R to the speaker 110R.

The mute circuits 220L and 220R perform the mute operation based on outputs Stl and Str of the touch sensors of the earplug units 100L and 100R, respectively. In other words, the mute circuits 220L and 220R mute outputs of the volume adjusting circuits 210L and 210R when the user inserts/removes the earplug units 100L and 100R into/from the external auditory canal 320 using the attaching/detaching auxiliary tools 103 and 104.

Figure 3:
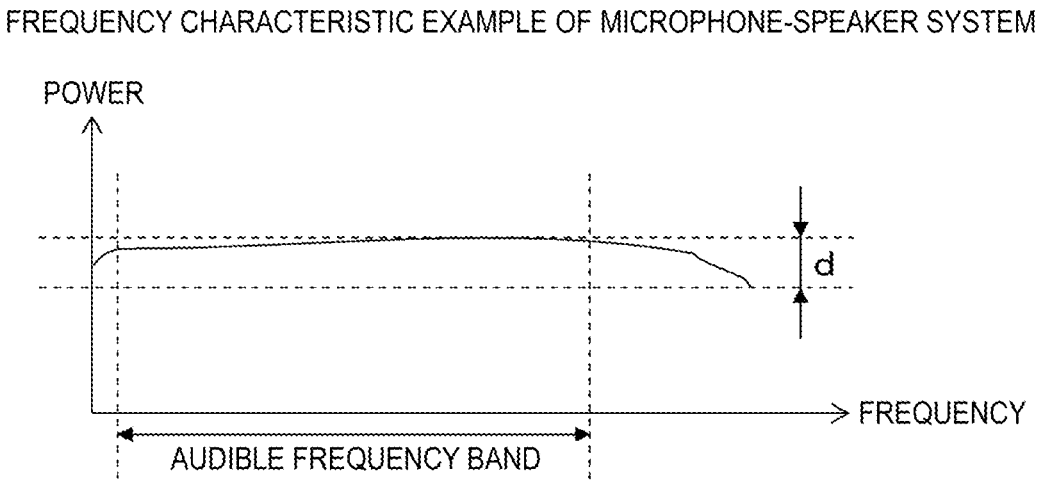
FIG. 3 is a diagram illustrating a frequency characteristic example of a system from a microphone to a speaker.

A frequency characteristic is smoothed in a band larger than at least an audible frequency band in a system from the microphone 120L to the speaker 110L. Similarly, a frequency characteristic is smoothed in a band larger than at least an audible frequency band in a system from the microphone 120R to the speaker 110R. FIG. 3 illustrates an example of a frequency characteristic of this system, and, for example, d is within 2 dB.

Next, an operation of the acoustic device 10 illustrated in FIGS. 1A, 1B, and 2 will be described. An operation at the left ear side is the same as that at the right ear side, and thus a description will be made in connection with the left ear side. The earplug unit 100L is inserted into the external auditory canal 320 for the left ear and then used as illustrated in FIG. 1. The microphone 120L collects a sound in this state. In this case, the microphone 120L is positioned near the entrance of the external auditory canal 320 and so collects a sound in which the user's head shape or auricle characteristic is reflected.

The output signal of the microphone 120L is amplified by the volume adjusting circuit 210L of the signal processing unit 200 and then supplied to the speaker 110L via the mute circuit 220L. Thus, the sound collected by the microphone 120L is amplified and then output toward the left eardrum 330 from the speaker 110L arranged at the eardrum 330 side of the earplug unit 100L. In this case, the user can arbitrarily adjust the volume of the output sound of the speaker 110L by rotating the adjusting knob 410 arranged in the housing 400 and adjusting the gain of the volume adjusting circuit 210L.

Further, when the user inserts/removes the earplug unit 100L into/from the external auditory canal 320 using the attaching/detaching auxiliary tools 103 and 104, the mute circuit 220L performs the mute operation based on the output Stl of the touch sensor of the earplug unit 100L. Thus, for example, even when the adjusting knob 410 is not at an "off" position, the output signal of the volume adjusting circuit 210L is not supplied to the speaker 110L, and the sound is not output from the speaker 110L.

As described above, in the acoustic device 10 illustrated in FIGS. 1A, 1B, and 2, the microphones 120L and 120R are arranged in the earplug units 100L and 100R to be inserted into the external auditory canal 320, respectively. Thus, a sound in which a user's head shape or auricle characteristic is reflected is collected by the microphones 120L and 120R.

Further, in the acoustic device 10 illustrated in FIGS. 1A, 1B, and 2, a frequency characteristic is smoothed in a band larger than at least an audible frequency band in a system from the microphones 120L and 120R to the speakers 110L and 110R (see FIG. 3). Thus, the sounds collected by the microphones 120L and 120R do not change in sound quality and are output from the speakers 110L and 110R.

Further, in the acoustic device 10 illustrated in FIGS. 1A, 1B, and 2, the earplug units 100L and 100R are inserted into the external auditory canal 320 and then used. Thus, sound is prevented from directly arriving at the eardrum 330 without passing through the system from the microphones 120L and 120R to the speakers 110L and 110R.

Thus, through the acoustic device 10 illustrated in FIGS. 1A, 1B, and 2, the user can appreciate music at a satisfactory volume in an environment in which sound leakage to an area around the user's room needs to be considered without damaging a feature of a music appreciation environment (the sound quality, a speaker arrangement, and the like) constructed by the user.

Further, in the acoustic device 10 illustrated in FIGS. 1A, 1B, and 2, the attaching/detaching auxiliary tools 103 and 104 arranged in the earplug units 100L and 100R include the built-in touch sensor. Further, the mute circuits 220L and 220R of the signal processing unit 200 perform the mute operation based on the outputs Stl and Str of the touch sensors. Thus, when the user inserts/removes the earplug units 100L and 100R into/from the external auditory canal 320 using the attaching/detaching auxiliary tools 103 and 104, a loud sound generated as the earplug unit rubs against the external auditory canal can be prevented from being output from the speakers 110L and 110R, thereby protecting an acoustic sense.

Further, in the acoustic device 10 illustrated in FIGS. 1A, 1B, and 2, the earplug units 100L and 100R have the dual structure of the outer member 101 and the inner member 102. Thus, when the earplug units 100L and 100R are repetitively inserted or removed and their outer sides get dirty, the outer member 101 can be easily restored to its original condition by replacement.

Further, in the circuit configuration of the acoustic device 10 illustrated in FIG. 2, the mute circuits 220L and 220R are activated by the outputs Stl and Str of the touch sensors arranged in the attaching/detaching auxiliary tools 103 and 104 of the earplug units 100L and 100R. Needless to say, a switch in which the user operates to activate the mute circuits 220L and 220R may be provided.

2. Second Embodiment

Configuration of Acoustic Device

Figure 4:
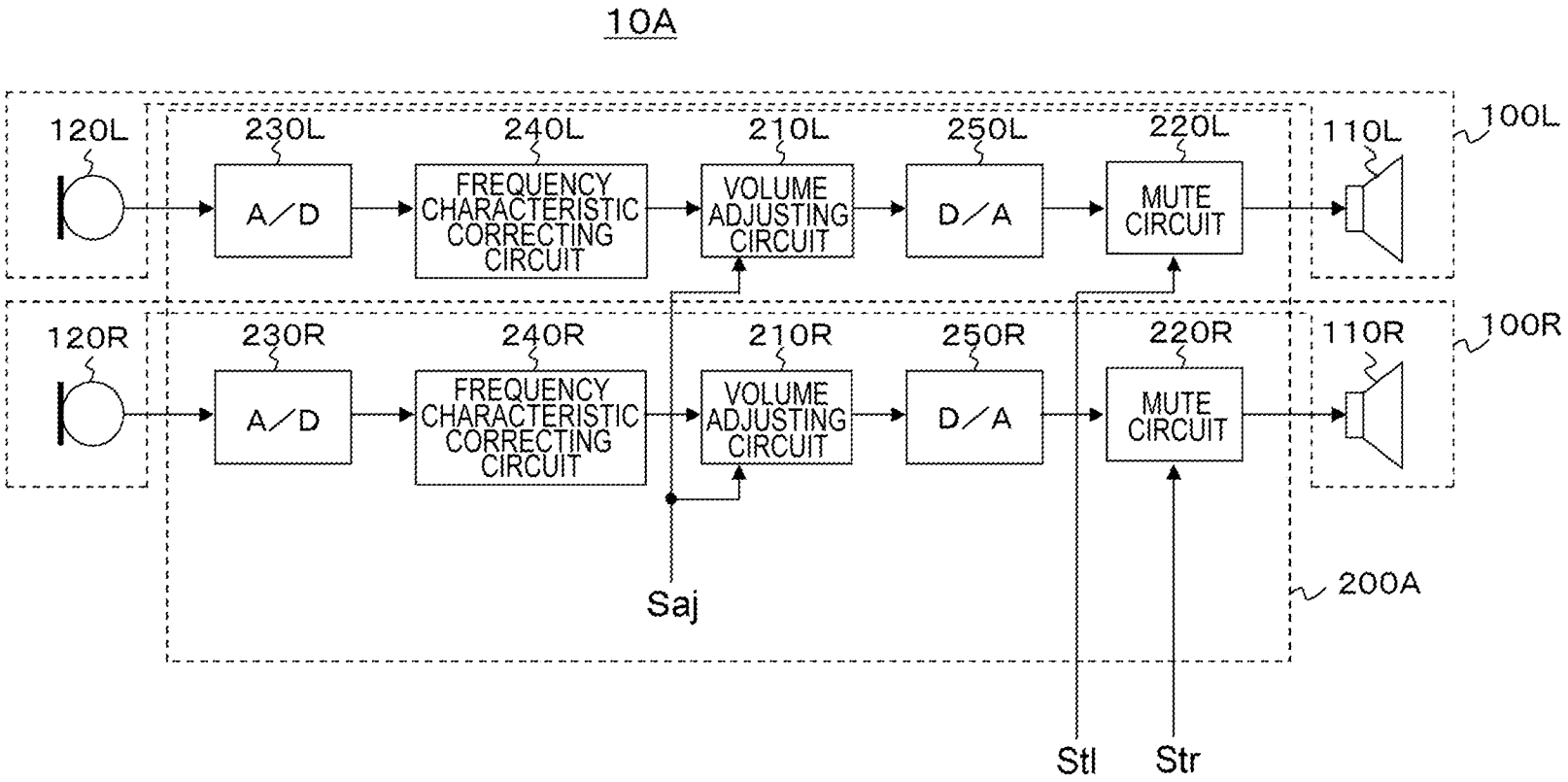
FIG. 4 is a block diagram illustrating a circuit configuration example of an acoustic device according to a second embodiment of the present technology.

FIG. 4 illustrates a circuit configuration example of an acoustic device 10A according to a second embodiment of the present technology. In FIG. 4, components corresponding to those in FIG. 2 are denoted by the same reference numerals, and a detailed description thereof will be omitted. In the second embodiment, the earplug units 100L and 100R have the same configuration as in the acoustic device 10 of the first embodiment (see FIG. 1).

A signal processing unit 200A arranged in the housing 400 (see FIG. 1) includes an analog-to-digital (A/D) converter 230L, a frequency characteristic correcting circuit 240L, a volume adjusting circuit 210L, a digital-to-analog (D/A) converter 250L, and a mute circuit 220L as a left signal system. Further, the signal processing unit 200A includes an A/D converter 230R, a frequency characteristic correcting circuit 240R, a volume adjusting circuit 210R, a D/A converter 250R, and a mute circuit 220R as a right signal system.

The A/D converters 230L and 230R convert output signals of the microphones 120L and 120R from analog signals to digital signals, respectively. The frequency characteristic correcting circuits 240L and 240R perform frequency characteristic correction on the output signals of the microphones 120L and 120R, respectively. In this case, the frequency characteristic correcting circuits 240L and 240R perform frequency characteristic correction so that frequency characteristics can be smoothed in a band larger than at least an audible frequency band by the systems from the microphones 120L and 120R to the speakers 110L and 110R, respectively.

In digital signal processing, in order to smoothly correct a frequency characteristic, it is desirable to apply characteristics opposite to frequency characteristics of the systems from the microphones 120L and 120R to the speakers 110L and 110R. For example, preferably, frequency characteristics specific to the systems from the microphones 120L and 120R to the speakers 110L and 110R are measured at the time of manufacture, and the correction process is performed to smooth the measured frequency characteristics. In other words, the frequency characteristic correcting circuits 240L and 240R perform frequency characteristic correction of characteristics opposite to frequency characteristics of the systems from the microphones 120L and 120R to the speakers 110L and 110R.

Figure 5:
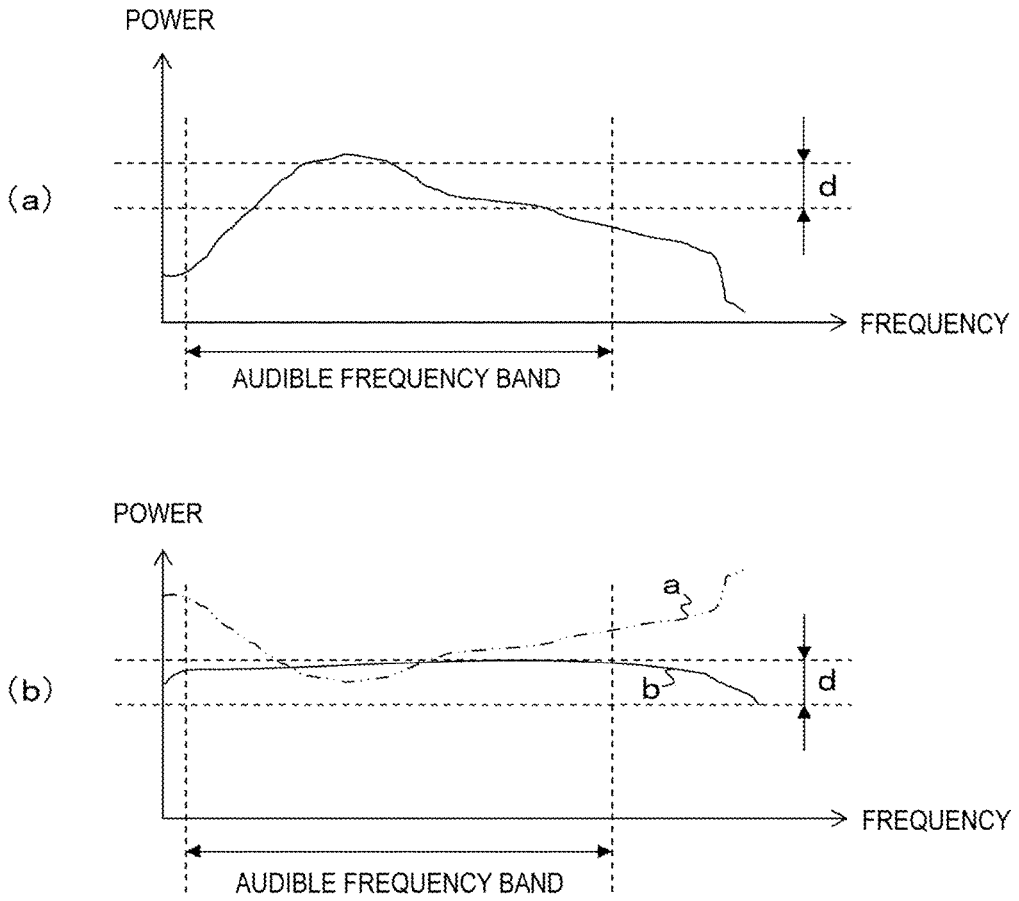
FIG. 5 is a diagram for explaining that correction is performed so that a frequency characteristic of a system from a microphone to a speaker is smoothed in a band larger than at least an audible frequency band.

For example, when a frequency characteristic of the systems from the microphones 120L and 120R to the speakers 110L and 110R is a frequency characteristic illustrated in FIG. 5A, the frequency characteristic correcting circuits 240L and 240R performs frequency characteristic correction of an opposite characteristic indicated by a dash-double-dot line a of FIG. 5B. As a result, a frequency characteristic of the systems from the microphones 120L and 120R to the speakers 110L and 110R is smoothed in a band larger than at least an audible frequency band as illustrated by a solid line b of FIG. 5B. In FIGS. 5A and 5B, for example, d is within 2 dB.

Figure 6:
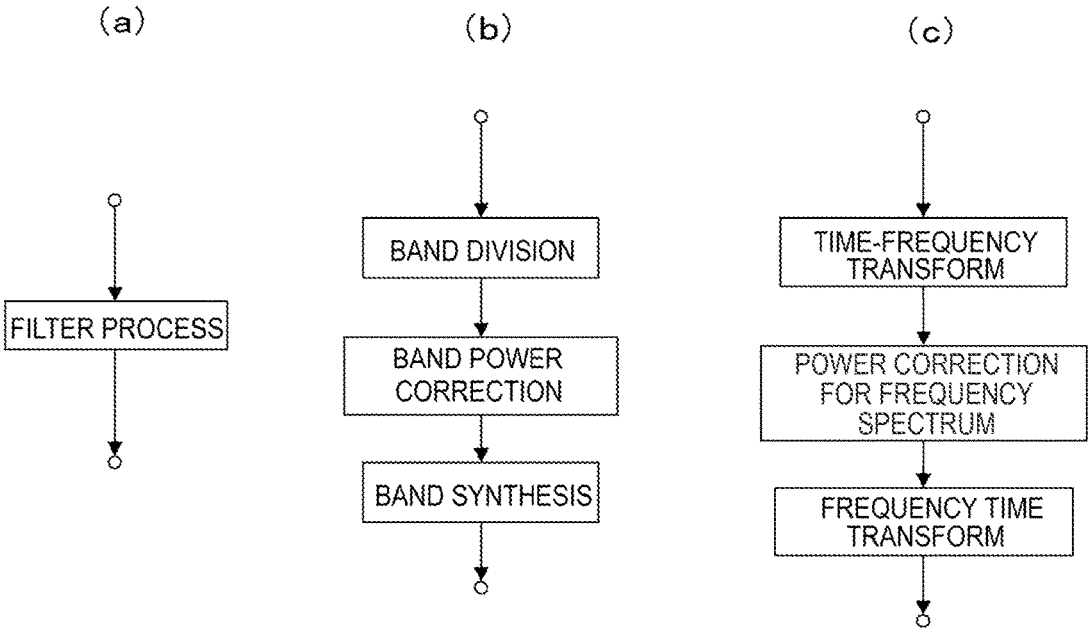
FIG. 6 is a diagram for explaining a frequency characteristic correction method of a frequency characteristic correction circuit.

The frequency characteristic correcting circuits 240L and 240R need a coefficient in correcting the frequency characteristic. The coefficient depends on a method of correcting the frequency characteristic. For example, correction may be performed by a filter process such as infinite impulse response (IIR) or finite impulse response (FIR). In this case, the coefficient is set so that correction can be performed to smooth the measured frequency characteristic. The frequency characteristic correcting circuits 240L and 240R perform the filter process on the input digital signal using the filter coefficient, and output the resultant signal as illustrated in FIG. 6A.

Further, for example, correction may be performed by band division such as ⅓ octave-band division. In this case, a correction value of each divided band is set as a coefficient. The frequency characteristic correcting circuits 240L and 240R perform band division on the input digital signal, correct power of the divided band signal using the set coefficient, execute a band synthesis process on each corrected band signal, and output a resultant signal as illustrated in FIG. 6B.

Further, for example, correction may be performed after a time-frequency transform such as a discrete Fourier transform (DFT) is performed. In this case, a correction value of each frequency spectrum is set as the coefficient. The frequency characteristic correcting circuits 240L and 240R perform a time-frequency transform on the input digital signal, correct power of each frequency spectrum, perform frequency-time transform, and output a resultant signal as illustrated in FIG. 6C.

Referring back to FIG. 4, each of the volume adjusting circuits 210L and 210R is configured with, for example, a VGA, and the gains of the volume adjusting circuits 210L and 210R are commonly adjusted based on the adjusting signal Saj generated according to the rotational position of the adjusting knob 410. The D/A converters 250L and 250R convert output signals of the volume adjusting circuits 210L and 210R from digital signals to analog signals, respectively.

The mute circuits 220L and 220R perform the mute operation based on the outputs Stl and Str of the touch sensors of the earplug units 100L and 100R, respectively. In other words, the mute circuits 220L and 220R mute outputs of the volume adjusting circuits 210L and 210R when the user inserts/removes the earplug units 100L and 100R into/from the external auditory canal 320 using the attaching/detaching auxiliary tools 103 and 104.

Next, an operation of the acoustic device 10A illustrated in FIG. 4 will be described. An operation at the left ear side is the same as that at the right ear side, and thus a description will be made in connection with the left ear side. The earplug unit 100L is inserted into the external auditory canal 320 for the left ear and then used as illustrated in FIG. 1. The microphone 120L collects a sound in this state. In this case, the microphone 120L is positioned near the entrance of the external auditory canal 320 and so collects a sound in which the user's head shape or auricle characteristic is reflected.

The output signal of the microphone 120L is converted from the analog signal to the digital signal by the A/D converter 230L of the signal processing unit 200A and then supplied to the frequency characteristic correcting circuit 240L. The frequency characteristic correcting circuit 240L performs frequency characteristic correction so that a frequency characteristic can be smoothed in a band larger than at least an audible frequency band in the system from the microphone 120L to the speaker 110L.

The signal whose frequency characteristic has been corrected by the frequency characteristic correcting circuit 240L is amplified by the volume adjusting circuit 210L, converted from the digital signal to the analog signal by the D/A converter 250L, and then supplied to the speaker 110L via the mute circuit 220L. As a result, the sound collected by the microphone 120L is amplified, and is output toward the left eardrum 330 from the speaker 110L of the earplug unit 100L arranged at the eardrum 330 side (see FIG. 1). In this case, the user can adjust the gain of the volume adjusting circuit 210L by rotating the adjusting knob 410 arranged in the housing 400, thereby arbitrarily adjusting the volume of the output sound of the speaker 110L.

Further, when the user inserts/removes the earplug unit 100L into/from the external auditory canal 320 using the attaching/detaching auxiliary tools 103 and 104, the mute circuit 220L performs the mute operation based on the output Stl of the touch sensor of the earplug unit 100L. Thus, for example, even when the adjusting knob 410 is not at an "off" position, the output signal of the volume adjusting circuit 210L is not supplied to the speaker 110L, and the sound is not output from the speaker 110L.

As described above, the acoustic device 10A illustrated in FIG. 4 has the same configuration as the acoustic device 10 illustrated in FIGS. 1A, 1B, and 2 and thus can have the same effects. In other words, through the acoustic device 10A illustrated in FIGS. 1A, 1B, and 2, the user can appreciate music at a satisfactory volume in an environment in which sound leakage to an area around the user's room needs to be considered without damaging a feature of a music appreciation environment (the sound quality, a speaker arrangement, and the like) constructed by the user.

Further, in the acoustic device 10A illustrated in FIG. 4, the signal processing unit 200A is configured to include the frequency characteristic correcting circuits 240L and 240R. The frequency characteristic correcting circuits 240L and 240R perform frequency characteristic correction so that frequency characteristics can be smoothed in a band larger than at least an audible frequency band by the systems from the microphones 120L and 120R to the speakers 110L and 110R, respectively. Thus, the system from the microphone to the speaker need not be configured with very expensive hardware having an excellent frequency characteristic and so can be configured at a low cost.

In the circuit configuration of the acoustic device 10A illustrated in FIG. 4, the volume adjusting circuits 210L and 210R are arranged at a stage prior to the D/A converters 250L and 250R and perform digital signal processing. However, the volume adjusting circuits 210L and 210R may be arranged at a stage subsequent to the D/A converters 250L and 250R and perform analog signal processing.

Further, in the circuit configuration of the acoustic device 10A illustrated in FIG. 4, the frequency characteristic correction process is performed by the frequency characteristic correcting circuits 240L and 240R, and thereafter the amplification process is performed by the volume adjusting circuits 210L and 210R. However, the frequency characteristic correction process and the amplification process may be performed at the same time. The digital signal processing is performed, for example, by a digital signal processor (DSP) or the like.

3. Third Embodiment

Configuration of Acoustic Device

Figure 7:
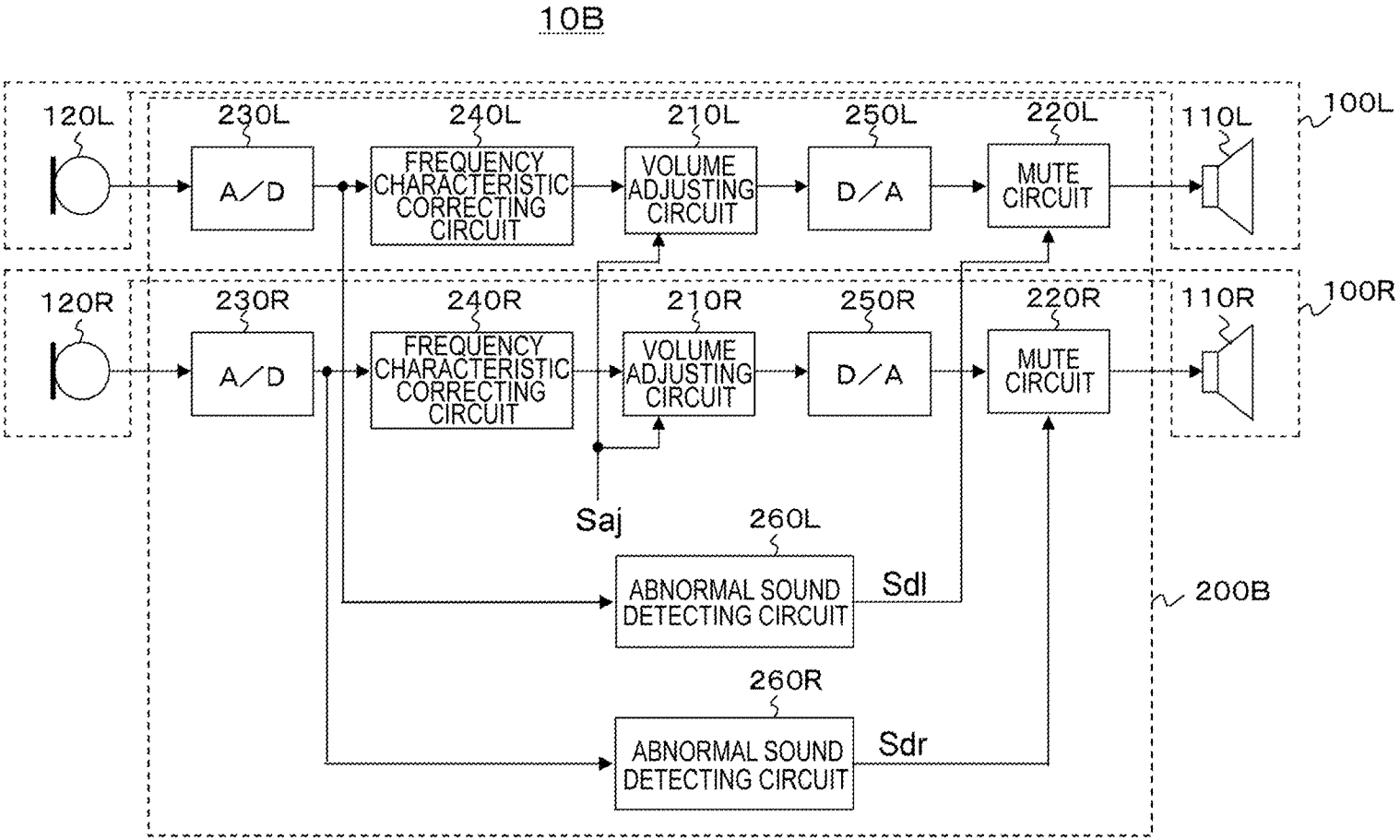
FIG. 7 is a block diagram illustrating a circuit configuration example of an acoustic device according to a third embodiment of the present technology.

FIG. 7 illustrates a circuit configuration example of an acoustic device 10B according to a third embodiment of the present technology. In FIG. 7, components corresponding to those in FIG. 4 are denoted by the same reference numerals, and a detailed description thereof will be omitted. In the third embodiment, the earplug units 100L and 100R have the same configuration as in the acoustic device 10 of the first embodiment (see FIG. 1) except that each of the attaching/detaching auxiliary tools 103 and 104 need not include the built-in touch sensor.

A signal processing unit 200B arranged in the housing 400 (see FIG. 1) includes an A/D converter 230L, a frequency characteristic correcting circuit 240L, a volume adjusting circuit 210L, a D/A converter 250L, a mute circuit 220L, and an abnormal sound detecting circuit 260L as a left signal system. Further, the signal processing unit 200B includes an A/D converter 230R, a frequency characteristic correcting circuit 240R, a volume adjusting circuit 210R, a D/A converter 250R, a mute circuit 220R, and an abnormal sound detecting circuit 260R as a right signal system.

The abnormal sound detecting circuits 260L and 260R detect an abnormal sound based on the output signals of the microphones 120L and 120R, and supply detection outputs Sdl and Sdr to the mute circuits 220L and 220R as mute control signals, respectively. The abnormal sound detecting circuits 260L and 260R detect a rubbing sound generated when the earplug units 100L and 100R are inserted into or removed from the external auditory canal 320 as the abnormal sound.

The mute circuits 220L and 220R perform the mute operation based on the detection outputs Sdl and Sdr of the abnormal sound detecting circuits 260L and 260R, respectively. In other words, when the abnormal sound detecting circuits 260L and 260R detect the abnormal sound such as the rubbing sound, the mute circuits 220L and 220R mute outputs of the volume adjusting circuits 210L and 210R, respectively.

Figure 8:
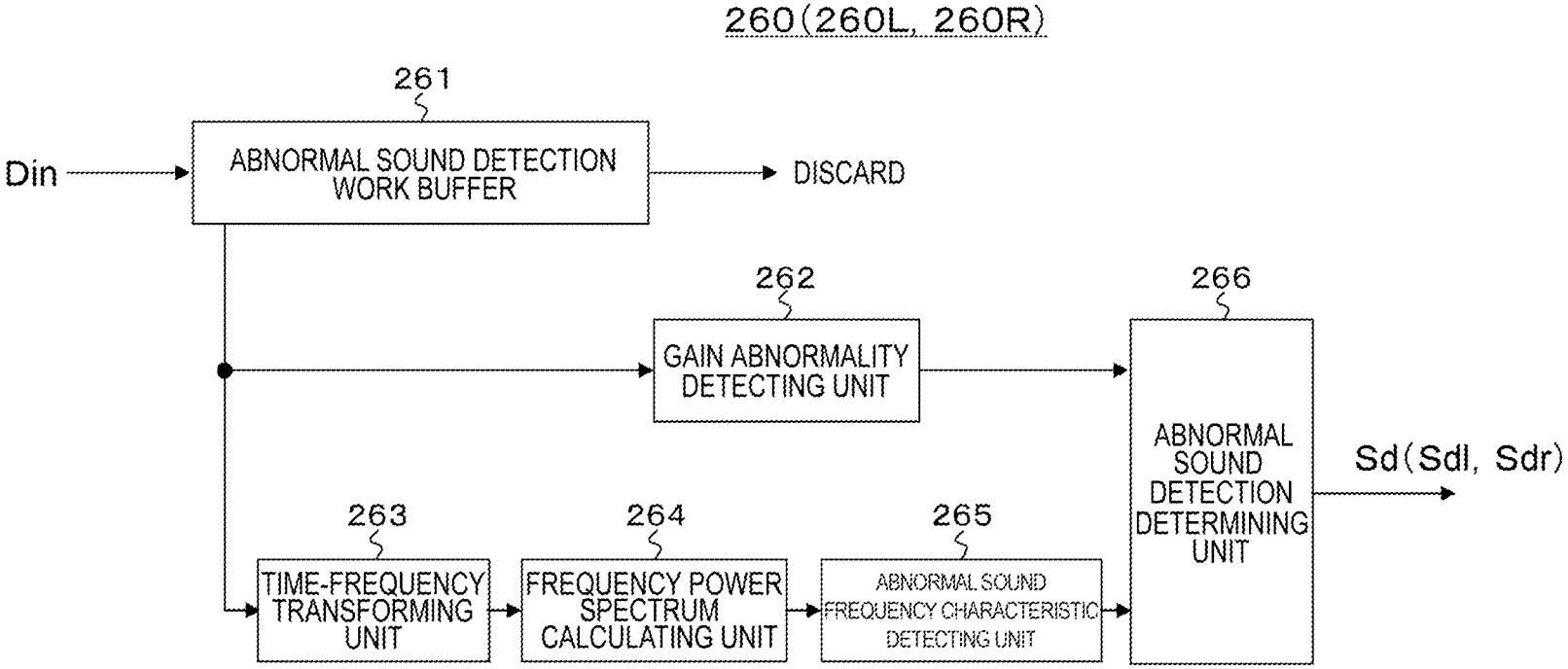
FIG. 8 is a block diagram illustrating a configuration example of an abnormal sound detecting circuit that detects an abnormal sound from an output signal of a microphone.

FIG. 8 illustrates a configuration example of the abnormal sound detecting circuit 260 (260L or 260R). The abnormal sound detecting circuit 260 includes an abnormal sound detection work buffer 261, a gain abnormality detecting unit 262, a time-frequency transforming unit 263, a frequency power spectrum calculating unit 264, an abnormal sound frequency characteristic detecting unit 265, and an abnormal sound detection determining unit 266.

In order to detect the abnormal sound, the abnormal sound detection work buffer 261 sequentially stores a digital signal Din input from the A/D converter 230 (230L or 230R) and discards the stored signal in order from an old signal when a predetermined time elapses. For example, the abnormal sound detection work buffer 261 functions as a circular buffer, and overwrites a new signal at an additional location. Alternatively, the abnormal sound detection work buffer 261 functions as a non-circular buffer, and adds a new signal by laterally moving an old signal.

The gain abnormality detecting unit 262 detects gain abnormality by scanning the digital signal stored in the abnormal sound detection work buffer 261 in the time direction and inspecting whether or not a signal gain is abnormal. For example, when a signal whose gain has suddenly significantly changed at the time of scanning in the time direction appears and then the state continues for a predetermined time, for example, for 5 msec, it is determined that gain abnormality has been detected. The gain abnormality detecting unit 262 transfers a detection result to the abnormal sound detection determining unit 266. For example, when gain abnormality has been detected, "1" is transferred as a detection signal, and in other cases, "0" is transferred as the detection signal.

The time-frequency transforming unit 263 performs time-frequency transform such as DFT on the digital signal stored in the abnormal sound detection work buffer 261, and transfers a transform output to the frequency power spectrum calculating unit 264. In the configuration example of the abnormal sound detecting circuit 260 illustrated in FIG. 8, the digital signal stored in the abnormal sound detection work buffer 261 is individually transferred to the gain abnormality detecting unit 262 and the time-frequency transforming unit 263. However, the digital signal that has been referred to by the gain abnormality detecting unit 262 may be transferred to the time-frequency transforming unit 263. For example, the frequency power spectrum calculating unit 264 calculates power of each spectrum, calculates a frequency power spectrum, and transfers the frequency power spectrum to the abnormal sound frequency characteristic detecting unit 265.

The abnormal sound frequency characteristic detecting unit 265 detects an abnormal sound by comparing the frequency power spectrum transferred from the frequency power spectrum calculating unit 264 with a feature of a frequency power spectrum of an abnormal sound which is previously specified, for example, at the time of design. For example, when power of a frequency band of a high-mid band is larger than that of other frequency bands, and the shape of the frequency power spectrum is similar to the previously acquired shape of the frequency power spectrum of the rubbing sound, it is determined that the abnormal sound has been detected. The abnormal sound frequency characteristic detecting unit 265 transfers a detection result to the abnormal sound detection determining unit 266. For example, "1" is transferred as the detection signal when the abnormal sound has been detected, and "0" is transferred as the detection signal in other cases.

The abnormal sound detection determining unit 266 decides the detection output Sd (Sdl or Sdr), i.e., a control signal to be transferred to the mute circuit 220 (220L or 220R), based on the detection results of the gain abnormality detecting unit 262 and the abnormal sound frequency characteristic detecting unit 265. For example, when "1" is received from at least one of the gain abnormality detecting unit 262 and the abnormal sound frequency characteristic detecting unit 265, in order to protect the acoustic sense, the abnormal sound detection determining unit 266 decides the detection output Sd for causing the mute circuit 220 to perform the mute operation.

The remaining configuration of the acoustic device 10B illustrated in FIG. 7 is similar to the acoustic device 10A illustrated in FIG. 4 and so will not be described.

Next, an operation of the acoustic device 10B of FIG. 7 will be described. An operation at the left ear side is the same as that at the right ear side, and thus a description will be made in connection with the left ear side. The earplug unit 100L is inserted into the external auditory canal 320 for the left ear and then used as illustrated in FIG. 1. The microphone 120L collects a sound in this state. In this case, the microphone 120L is positioned near the entrance of the external auditory canal 320 and so collects a sound in which the user's head shape or auricle characteristic is reflected.

The output signal of the microphone 120L is converted from the analog signal to the digital signal by the A/D converter 230L of the signal processing unit 200B and then supplied to the frequency characteristic correcting circuit 240L. The frequency characteristic correcting circuit 240L performs frequency characteristic correction so that a frequency characteristic can be smoothed in a band larger than at least an audible frequency band in the system from the microphone 120L to the speaker 110L.

The signal whose frequency characteristic has been corrected by the frequency characteristic correcting circuit 240L is amplified by the volume adjusting circuit 210L, converted from the digital signal to the analog signal by the D/A converter 250L, and then supplied to the speaker 110L via the mute circuit 220L. As a result, the sound collected by the microphone 120L is amplified, and is output toward the left eardrum 330 from the speaker 110L of the earplug unit 100L arranged at the eardrum 330 side (see FIG. 1). In this case, the user can adjust the gain of the volume adjusting circuit 210L by rotating the adjusting knob 410 arranged in the housing 400, thereby arbitrarily adjusting the volume of the output sound of the speaker 110L.

Further, when the abnormal sound detecting circuit 260L detects the abnormal sound such as the rubbing sound when the user inserts/removes the earplug unit 100L into/from the external auditory canal 320 using the attaching/detaching auxiliary tools 103 and 104, the mute circuit 220L performs the mute operation based on the detection output Sdl. Thus, for example, even when the adjusting knob 410 is not at an "off" position, the output signal of the volume adjusting circuit 210L is not supplied to the speaker 110L, and the abnormal sound is not output from the speaker 110L.

As described above, the acoustic device 10B illustrated in FIG. 7 has the same configuration as the acoustic device 10A illustrated in FIG. 4 and thus can have the same effects. Further, the acoustic device 10B illustrated in FIG. 7 is provided with the abnormal sound detecting circuits 260L and 260R that detect the abnormal sound such as the rubbing sound generated when the user inserts/removes the earplug units 100L and 100R into/from the external auditory canal 320. The detection outputs Sdl and Sdr are output to the mute circuits 220L and 220R as the mute control signal.

Thus, when the abnormal sound such as the rubbing sound is generated when the earplug units 100L and 100R are inserted or removed, the mute circuits 220L and 220R perform the mute operation. Accordingly, a loud sound of the abnormal sound such as the rubbing sound can be prevented from being output from the speakers 110L and 110R, and thus the acoustic sense can be protected.

4. Modified Embodiment

In the circuit configurations of the acoustic devices 10, 10A, and 10B of the above embodiment, the volume adjusting circuits 210L and 210R and the mute circuits 220L and 220R are arranged. However, the outputs Stl and Str of the touch sensors or the detection outputs Sdl and Sdr of the abnormal sound detecting circuits 260L and 260R may be supplied to the volume adjusting circuits 210L and 210R as the mute control signal, and the mute operation may be performed such that a setting volume is temporarily muted.

In this case, the mute circuits 220L and 220R need not necessarily be arranged. In this case, not only a function of turning the mute operation on or off but also a function of adding an effect of gradually restoring the volume may be provided.

Figure 9:
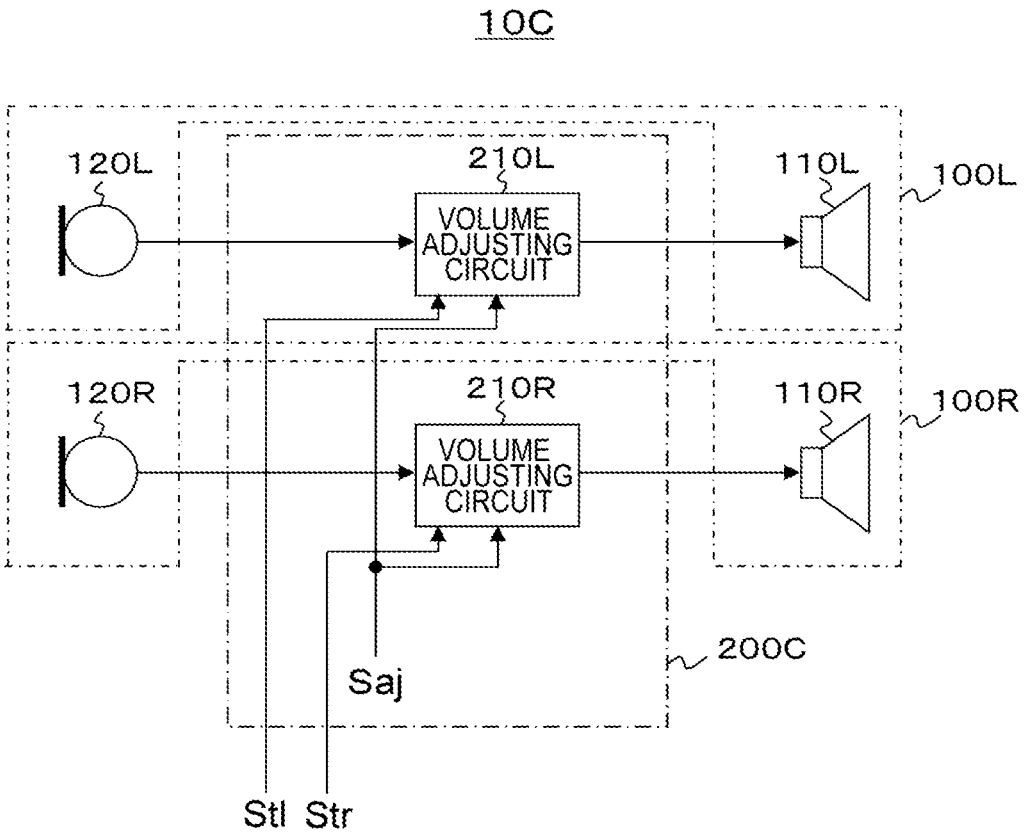
FIG. 9 is a block diagram illustrating another configuration example of an acoustic device.

FIG. 9 illustrates an example of a circuit configuration of an acoustic device 10C in that case. The signal processing unit 200C is configured to include only volume adjusting circuits 210L and 210R. This circuit configuration corresponds to the circuit configuration of the acoustic device 10 illustrated in FIG. 2, however, a circuit configuration corresponding to the circuit configurations of the acoustic devices 10A and 10B illustrated in FIGS. 4 and 7 can be similarly configured.

In the acoustic devices 10, 10A, and 10B, the housing 400 and the earplug units 100L and 100R are connected to each other and integrated into each other by the signal lines 105L and 105R. However, an acoustic device may be configured such that a left ear part is separated from a right ear part. In this case, an acoustic device for each ear may include, for example, a housing that includes an earplug unit and a signal processing unit and is shaped to be arranged on the back side of an ear. In this case, the volume may be adjusted such that the left and right acoustic devices are synchronized with each other using an appropriate wireless scheme such as near field communication (NFC).

In the above embodiments, the signal processing units 200 and 200A to 200C may be arranged in the housing 400 present outside the earplug units 100L and 100R. However, the signal processing units 200 and 200A to 200C may be configured to be included in the earplug units 100L and 100R. Through this configuration, the acoustic device which is convenient for the user to use can be provided.

It should be understood by those skilled in the art that various modifications, combinations, sub-combinations and alterations may occur depending on design requirements and other factors insofar as they are within the scope of the appended claims or the equivalents thereof.

Additionally, the present technology may also be configured as below.

(1)

An acoustic device, comprising:

an earplug unit that is inserted into an external auditory canal, and includes a speaker arranged at an eardrum side and a microphone arranged at a side opposite to the eardrum side; and a signal processing unit that processes an output signal of the microphone and supplies the processed signal to the speaker, wherein the signal processing unit includes a volume adjusting unit that performs an amplification process on the output signal of the microphone, and a frequency characteristic is smoothed in a band larger than at least an audible frequency band in a system from the microphone to the speaker.

(2)

The acoustic device according to (1), wherein the signal processing unit further includes a frequency characteristic correcting unit that performs frequency characteristic correction of a characteristic opposite to a frequency characteristic in the system from the microphone to the speaker on the output signal of the microphone.

(3)

The acoustic device according to (1) or (2), wherein the signal processing unit further includes a mute processing unit that performs a mute process on the output signal of the microphone.

(4)

The acoustic device according to (3), wherein the earplug unit includes an attaching/detaching auxiliary tool having a built-in touch sensor, and the mute processing unit performs a mute operation based on an output of the touch sensor.

(5)

The acoustic device according to (3), wherein the signal processing unit further includes an abnormal sound detecting unit that detects an abnormal sound based on the output signal of the microphone, and the mute processing unit performs a mute operation based on a detection output of the abnormal sound detecting unit.

(6)

The acoustic device according to (5), wherein the abnormal sound detecting unit includes an abnormal sound detection work buffer that sequentially stores the output signal of the microphone, a gain abnormality detecting unit that detects gain abnormality by scanning a signal stored in the abnormal sound detection work buffer in a time direction and inspecting whether or not a signal gain is abnormal, a time-frequency transforming unit that performs a time-frequency transform on a signal stored in the abnormal sound detection work buffer, a frequency power spectrum calculating unit that calculates power of each spectrum based on an output of the time-frequency transforming unit and calculates a frequency power spectrum, an abnormal sound frequency characteristic detecting unit that compares the frequency power spectrum calculated by the frequency power spectrum calculating unit with a characteristic of a frequency power spectrum of a predefined abnormal sound, and detects an abnormal sound, and an abnormal sound detection determining unit that obtains the detection output of the abnormal sound detecting unit based on detection results of the gain abnormality detecting unit and the abnormal sound frequency characteristic detecting unit.

(7)

The acoustic device according to any one of (1) to (6), wherein the earplug unit includes an outer member that comes into contact with the external auditory canal and an inner member whose outer circumference is covered with the outer member, and the speaker and the microphone are arranged in the inner member (8)

A method of detecting an abnormal sound from an output signal of a microphone in an earplug unit that is inserted into an external auditory canal, and includes a speaker arranged at an eardrum side and the microphone arranged at a side opposite to the eardrum side, the method comprising:

a gain abnormality detection step of detecting gain abnormality by scanning the output signal of the microphone in a time direction and inspecting whether or not a signal gain is abnormal;

a time-frequency transform step of performing time-frequency transform on the output signal of the microphone;

a frequency power spectrum calculation step of calculating power of each spectrum obtained in the step of performing the time-frequency transform and calculating a frequency power spectrum;

an abnormal sound frequency characteristic detection step of detecting an abnormal sound by comparing the frequency power spectrum calculated in the step of calculating the frequency power spectrum with a feature of a frequency power spectrum of a predefined abnormal sound; and an abnormal sound detection determination step of obtaining an abnormal sound detection signal based on detection results of the step of detecting the gain abnormality and the step of detecting the abnormal sound frequency characteristic.

The present application contains subject matter related to that disclosed in Japanese Priority Patent Application JP 2011-104034 filed in the Japan Patent Office on May 9, 2011, the entire content of which is hereby incorporated by reference.

What is claimed is:

1. An acoustic device, comprising:

an earplug unit configured for insertion into an external auditory canal of a user, wherein the earplug unit comprises a speaker arranged at an eardrum side and a microphone arranged at a side opposite to the eardrum side, wherein the earplug unit comprises a first attaching/detaching auxiliary tool and a second attaching/detaching auxiliary tool;

a signal processing unit configured to process an output signal of the microphone and supply a processed signal to the speaker;

an abnormal sound detection work buffer configured to store the output signal of the microphone;

a gain abnormality detecting unit configured to inspect abnormality in a signal gain of the stored output signal to detect a gain abnormality, wherein the abnormality in the signal gain of the stored output signal is inspected for a threshold time duration to detect the gain abnormality;

a time-frequency transforming unit configured to time-frequency transform the output signal of the microphone;

a frequency power spectrum calculating unit configured to calculate a power of each spectrum based on an output of the time-frequency transforming unit and calculate a frequency power spectrum based on the calculated power; and an abnormal sound frequency characteristic detecting unit configured to detect an abnormal sound by a comparison of a shape of the frequency power spectrum calculated by the frequency power spectrum calculating unit and a shape of a frequency power spectrum of the abnormal sound.

2. The acoustic device according to claim 1, wherein the signal processing unit comprises a frequency characteristic correcting unit configured to correct a first frequency characteristic of the acoustic device, based on a characteristic opposite to a second frequency characteristic in a system from the microphone to the speaker on the output signal of the microphone.

3. The acoustic device according to claim 1, wherein the signal processing unit comprises a mute processing unit configured to mute a sound of the speaker based on an operation on the output signal of the microphone.

4. The acoustic device according to claim 3, wherein each of the first attaching/detaching auxiliary tool and the second attaching/detaching auxiliary tool comprises a built-in touch sensor, and wherein the sound of the speaker is muted based on an output of the built-in touch sensor.

5. The acoustic device according to claim 3, wherein the signal processing unit further comprises an abnormal sound detecting unit configured to detect the abnormal sound based on the output signal of the microphone, and wherein the mute processing unit is further configured to mute the sound of the speaker based on an output of the abnormal sound detecting unit.

6. The acoustic device according to claim 5, wherein the gain abnormality detecting unit is further configured to scan the output signal stored in the abnormal sound detection work buffer in a time direction, wherein the time-frequency transforming unit is further configured to time-frequency transform the output signal stored in the abnormal sound detection work buffer, and wherein the acoustic device further comprises an abnormal sound detection determining unit configured to obtain the output of the abnormal sound detecting unit based on detection results of the gain abnormality detecting unit and the abnormal sound frequency characteristic detecting unit.

7. The acoustic device according to claim 1, wherein the earplug unit further includes an outer member that comes into contact with the external auditory canal and an inner member whose outer circumference is covered with the outer member, and wherein the speaker and the microphone are arranged in the inner member.

8. A sound detection method, comprising:

detecting an abnormal sound from an output signal of a microphone in an earplug unit that is configured to be inserted into an external auditory canal, and includes a speaker arranged at an eardrum side and the microphone arranged at a side opposite to the eardrum side, wherein the detecting further comprising:

detecting a gain abnormality by scanning the output signal of the microphone in a time direction and inspecting abnormality in a signal gain of the output signal, wherein the abnormality in the signal gain of the output signal is inspected for a threshold time duration to detect the gain abnormality;

time-frequency transforming the output signal of the microphone;

calculating a power of each spectrum obtained in the time-frequency transform;

calculating a frequency power spectrum based on the calculated power;

detecting an abnormal sound by comparing a shape of the frequency power spectrum calculated in the calculating of the frequency power spectrum with a shape of a frequency power spectrum of the abnormal sound;

obtaining an abnormal sound detection signal based on detection results of the detecting of the gain abnormality and the detecting of the abnormal sound;

outputting a mute control signal based on the abnormal sound detection signal; and muting sound of the speaker of the earplug unit based on the mute control signal.

* * * * *